United States Patent [19]

Green

[11] Patent Number: 5,077,126

[45] Date of Patent: Dec. 31, 1991

[54] PROCESS FOR MAKING COTTON BLEND WARP YARNS FOR DURABLE FABRICS

[75] Inventor: James R. Green, Hockessin, Del.

[73] Assignee: E. I. Du Pont de Nemours & Company, Wilmington, Del.

[21] Appl. No.: 489,276

[22] Filed: Mar. 5, 1990

[51] Int. Cl.[5] ..... D02G 3/00; D02G 3/02; D02G 3/36; D01H 4/00

[52] U.S. Cl. ..... 428/374; 57/2; 57/252; 57/255; 57/256; 57/310; 57/400; 428/373; 428/902

[58] Field of Search ..... 428/258, 374, 276, 373; 57/256, 257, 252, 310, 400; 8/120; 28/165, 167

[56] References Cited

U.S. PATENT DOCUMENTS 4,111,816 9/1978 Login ..... 428/276
4,900,613 2/1990 Green ..... 428/258

*Primary Examiner*—George F. Lesmes
*Assistant Examiner*—James D. Withers

[57] ABSTRACT

Staple yarns of cotton and high modulus fiber are wet and then dried under tension to provide warp yarn for durable, abrasion resistant fabrics.

3 Claims, No Drawings

PROCESS FOR MAKING COTTON BLEND WARP YARNS FOR DURABLE FABRICS

RELATED APPLICATIONS

The subject matter of this application is related to that of my application Ser. No. 07/343,391, now U.S. Pat. No. 4,900,613.

BACKGROUND OF THE INVENTION

This invention relates to continuous yarns that can be employed as warp yarns of woven fabrics to give high abrasion resistance. The fabrics thereof have long wear life and with appropriate selection of fill yarn, are suitable for making comfortable garments.

SUMMARY OF THE INVENTION

This invention provides a process for preparing cotton blend yarns for durable fabrics comprising:

a. Forming a staple fiber blend of from about 35 to 90 wt. percent cotton fiber, about 10 to 50 wt. percent organic polymeric fiber having a modulus of at least 200 grams per decitex (g/dtex), and optionally, up to 55 wt. percent of other fiber having a modulus of less than 100 g/dtex;

b. Spinning the fiber blend to form a continuous yarn;

c. Wetting the yarn thoroughly with an aqueous bath;

d. Drying the wet yarn under a tension of from 0.2 to 2 g/dtex; and e. Collecting the yarn.

The resulting yarns are also part of this invention. Durable woven fabrics having a high resistance to abrasion may be prepared by employing the novel yarns as the warp yarn of woven fabrics with a fill yarn containing 0 to 50% by wt. of high modulus organic polymer fiber, 35 to 100% cotton and 0 to 65% of other low modulus, i.e. under 100 gpd, organic fiber, and weaving a fabric having a fabric tightness value of at least 1.

DETAILED DESCRIPTION OF THE INVENTION

The staple fibers used herein are textile fibers having a linear density suitable for wearing apparel, i.e. less than 10 decitex per fiber, preferably less than 5 decitex per fiber, and lengths from 1.9 to 6.3 cm (0.75 to 2.5 in). Still more preferred are fibers that have a linear density of from 1 to about 3 decitex per fiber. Crimped fibers are particularly preferred for textile aesthetics and processability.

The process for making the fabric involves the steps of first preparing a blend of 10–50% high modulus fiber, 35–90% cotton and 0–55% low modulus organic staple fibers. A continuous yarn is spun from the blend and subjected to a stretch tightening process which consists of throughly wetting the yarn with an aqueous solution, preferably water, applying 0.2 to 2.0 g/dtex tension and drying the yarn while under tension preferably, at temperatures of about 100° C. As will be understood by those skilled in the art, the spun yarn should have sufficient twist or entanglement to withstand the stretch tightening process. Fabric is woven using these continuous yarns as the warp and a fill yarn containing 0–50% high modulus fiber, 35–100% cotton and 0–65% other low modulus organic staple fibers. In the fill yarn, too much high modulus fiber (over 200 g/dtex) or low shrinkage, low modulus fiber will prevent the fill from shrinking sufficiently upon washing to hold the warp yarn tightly together for increased abrasion resistance.

Cotton in the fill provides softness and water absorption and shrinks upon laundering to compress the warp yarns.

It is important to maintain the proper content of the fiber types in the novel yarn to achieve the desired results. Too much or too little high modulus fiber in the warp yarn results in fabric having inadequate resistance to hard surface abrasion. The presence of cotton in the warp yarn provides a soft hand and moisture absorption and upon shrinkage locks the compacted high modulus fibers in the fabric structure to enhance abrasion resistance. Other fibers having a modulus of less than 100 g/dtex may be present to provide greater strength or modified aesthetics.

The yarn of the staple fiber blend is then thoroughly wet. Passage of the yarn through an aqueous bath gives satisfactory results. Aqueous solutions containing small amounts of additives may be used in place of pure water to obtain additional benefits such as improved luster or resistance to ozone. Lubricant finishing aids may also be incorporated in this wetting step. Tension is applied to the wet yarn and the yarn is dried by heating while under tension. One method of accomplishing this is by passing the yarn over and between heated rolls. Temperatures of about 100° C. are usefully employed to accelerate the drying. A level of tension is applied during the drying step, that ranges from about 0.2 to 2 g/dtex. Levels approaching 2 g/dtex are employed when proportions of high modulus fiber approach the upper permissible limit and tensions close to 0.2 g/dtex are used with low proportions of high modulus fiber. The stretch-tightened yarn is collected in a container for transfer to the weaving area.

If tension is too low during stretch tightening, inadequate compaction will occur and inferior results will be obtained. The tension should not be so high as to prevent shrinkage of the cotton during drying. The higher the content of the high modulus fiber, the higher the tension allowed, as mentioned previously.

It is believed that in the stretch tightening process, the high modulus fibers take up most of the load and are compacted when the yarn is under tension while the cotton fibers are under relatively low tension and are mobile. Drying under tension allows the cotton to tighten around the already compacted high modulus fibers thereby holding them in a locked position once the yarn is dried. Failure to stretch tighten the yarn prior to incorporation in the fabric results in the high modulus fibers being present in a loose relaxed state. Washing such fabrics to effect shrinkage is not sufficient to achieve the result desired herein. Likewise, cotton blend yarns allowed to shrink under insufficient tension will not develop the fiber tightness necessary for purposes of this invention.

As shown in Example 1 below, a substantial increase in Taber abrasion resistance over a control fabric is achieved when the warp yarn is stretch tightened prior to weaving the fabric. Fabrics of the invention have a hard surface Taber abrasion more than 50% above that of a fabric where the warp yarn is not treated prior to weaving.

The fibers can be spun into yarns by a number of different spinning methods, including but not limited to ring spinning, open end spinning, air jet spinning and friction spinning.

Nylon is a preferred additive low modulus fiber for this process because it shrinks readily when wetted and dried thereby aiding the warp yarn tightening process. Other low modulus fibers such as polyethylene terephthalate and other polyesters, polyacrylonitrile and other acrylic fibers, polybenzimidazole and poly (m-phenylene isophthalamide) are also suitable within the proportions specified.

An exemplary high modulus fiber for use in the present invention is poly(p-phenylene terephthalamide) (PPD-T) staple fiber. This fiber can be prepared as described in U.S. Pat. No. 3,767,756 and is commercially available.

Other organic staple fibers having a modulus of at least 200 g/decitex may be used including, but not limited to, the following:

High-modulus fiber of a copolymer of terephthalic acid with a mixture of diamines comprising 3,4'-diaminodiphenyl ether and p-phenylenediamine as disclosed in U.S. Pat. No. 4,075,172.

High-modulus fiber of high molecular weight polyethylene, solution spun to form a gel fiber and subsequently stretched, as disclosed in U.S. Pat. No. 4,413,110 and U.S. Pat. No. 4,430,383.

High modulus, ultra-high tenacity fiber of polyvinyl alcohol having a degree of polymerization of at least 1500, made by the dry-jet wet spinning process, as disclosed in U.S. Pat. No. 4,603,083.

High-modulus fiber spun from an anisotropic melt-forming polyester or copolyester, and heat-treated after spinning, of the class disclosed in U.S. Pat. No. 4,161,470, U.S. Pat. No. 4,118,372 and U.S. Pat. No. 4,183,895. An example of such a polymer is the copolyester of equimolar amounts of p-hydroxybenzoic acid and 6-hydroxy-2-naphthoic acid.

The term "organic staple fibers" as used herein, means staple fibers of polymers containing both carbon and hydrogen and which may also contain other elements such as oxygen and nitrogen. By "continuous yarn" is meant a windable yarn of indefinite length as in commonly employed in the manufacture of woven fabrics.

For some applications, it may be desirable to dye the warp yarns during the stretch tightening process in order to produce a warp dyed fabric.

During finishing of fabrics of the invention, many fabric treatments can be carried out; fabrics can be dyed, mercerized, and flame retarded. If done under 0.2–2.0 g/dtex warp tension while drying, abrasion resistance can be further enhanced. Compressive shrinkage such as Sanforization® may be done to reduce laundry shrinkage.

Test Measurements

All fabric tests and measurements are preceded by subjecting fabrics to be tested to five wash/dry cycles. The wash/dry cycle consists of washing the fabric in a conventional home washing machine in laundry detergent at 57° C. (135° F.) with 14 minutes agitation followed by rinsing the fabric at 37° C. (100° F.) and drying in a conventional tumble dryer to a maximum dryness at a final (maximum) temperature of 71° C. (160° F.) Usually a drying time of about 30 minutes is required.

Determination of Fabric Tightness

The degree to which yarns are jammed together within a woven fabric is defined as "fabric tightness" and is determined and calculated as described in *RESEARCH DISCLOSURE*, October, 1988, Publication Item No. 29498, "Calculation of Fabric Tightness Factor", pp. 833–6 (the word "factor" being omitted herein). The linear density of a yarn in decitex or cotton count is determined by removing the yarn from the washed fabric, hand stretching the yarn to obtain the length of the yarn without weave crimp, and then weighing that length to determine an approximate linear density; then loading the yarn to 0.11 g/dtex and determining its length under the load. The length determined in this way is used together with the weight of the same length of yarn to calculate the linear density used in the formula for fabric tightness.

Abrasion Resistance

Abrasion resistance was determined using ASTM Method D3884-80 with a H-18 wheel, 1000 gm load on a Taber abrasion machine available from Teledyne Taber, 455 Bryant St., North Tonawanda, N.Y. 14120. Samples are ironed flat before testing. As called for in the procedure, care must be taken to mount the samples tightly in the holder to avoid wrinkles. Taber abrasion resistance is reported as cycles to failure.

EXAMPLE 1

A highly durable fabric of the present invention was prepared from a warp of ring-spun yarns of intimate blends of PPD-T staple fibers, cotton and nylon staple fibers. The fill was open-end spun, 100% cotton.

A blend sliver of 25 wt. % PPD-T fibers having a linear density of 1.65 decitex (1.5 dpf) of a cut length of 3.8 cm (1.5 in), 10 wt. % of polyhexamethylene adipamide (6,6 nylon) fibers having a linear density of 2.77 dtex (2.5 dpf) and a cut length of 3.8 cm (1.5 in) (available as T-420 nylon fiber from E. I. du Pont de Nemours & Co., Inc.) and 65 wt. % cotton was prepared and processed by the conventional cotton system into a spun yarn having 3.9 turns per cm of "Z" twist (10 tpi) using a ring spinning frame. The yarn so made was 913 dtex (nominal 6.4/1 cotton count: 830 denier) single spun yarn. The yarns were then run through several room temperature water baths containing indigo dye then passed through hot air chambers. The yarn is then rinsed with hot water and as a final step dried on rolls at 82° C. under a tension of about 0.5 g/dtex. The single spun yarn so formed was used as the warp to weave a 3×1 right hand twill construction with a 5.75/1 cotton count (1017 dtex, 924 denier) open-end spun fill of 100% cotton. The twill fabric had a construction of 25 ends per cm×19 picks per cm (64 ends per in×48 picks per in), a basis weight of 511 g/m$^2$ (15.1 oz/yd$^2$), a Taber abrasion of 2700 cycles and a fabric tightness of 1.09.

For comparison, a similarly constructed fabric of the same composition except with a ring spun fill and no stretch tightening of the warp had a Taber abrasion of only 1700 cycles.

EXAMPLE 2

Fabric was made as in Example 1, except that a blend sliver of 20 wt % blue dyed PPD-T fibers, 15 wt % 6,6 nylon fibers (T-420 from E. I. du Pont de Nemours and Company), and 65 wt % cotton was used to make the warp yarn. The fabric had a Taber abrasion of 2600 cycles.

I claim:

1. A method of preparing cotton blend yarns for durable fabrics comprising:

a. Forming a staple fiber blend of from about 35 to 90 weight % cotton fiber, about 10 to 50 weight % organic polymeric fiber having a modulus of at least 200 g/dtex and optionally up to 55 weight % of other fiber having a modulus of less than 100 g/dtex;

b. Spinning the fiber blend to form a continuous yarn;

c. Wetting the yarn thoroughly with an aqueous bath;

d. Drying the wet yarn under tension of from 0.2 to 2 g/dtex; and e. Collecting the yarn.

2. A method according to claim 1 wherein the organic polymer fiber having a modulus of at least 200 g/dtex is poly(p-phenylene terephthalamide) fiber.

3. A continuous yarn prepared by the process of claims 1 or 2.

* * * * *